US005411453A

United States Patent [19]

Wilson

[11] Patent Number: 5,411,453

[45] Date of Patent: May 2, 1995

[54] PULL UP DEVICE WITH THUMB GRASPING KNOBS

[76] Inventor: Charles Wilson, 1472 S. Evergreen Ave., Clearwater, Fla. 34616

[21] Appl. No.: 278,606

[22] Filed: Jul. 21, 1994

[51] Int. Cl.[6] ..... A63B 1/00

[52] U.S. Cl. ..... 482/38; 482/148

[58] Field of Search ..... 482/37, 38, 39, 41, 482/42, 44, 148, 49

[56] References Cited

U.S. PATENT DOCUMENTS

| | | | |
|---|---|---|---|
| 3,156,165 | 11/1964 | Jacobi | 482/38 |
| 4,620,701 | 11/1986 | Mojden | 482/41 |
| 5,205,802 | 4/1993 | Swisher | 482/49 |
| 5,230,684 | 7/1993 | Wallisch | 482/148 |

*Primary Examiner*—Stephen R. Crow

[57] ABSTRACT

A device which mounts on uprights which enables an individual, when gripping it, to go through the range of motion of the pronated pull up exercise easier than gripping a round bar, due to an increase in muscle capacity. This is made possible by having two knobs for the thumbs to grasp projecting from the top of the device next to the center sides of two curves cut out of the top of the rectangular body of the device. In use, the device is first mounted on uprights that are high enough so that the user is suspended from the ground when gripping the device. The user then wraps his or her fingers around the curved openings and clutches the thumb knobs with his or her thumbs and performs the pronated pull up exercise, strengthening the muscles of the trunk and arms and stretching the back. The thumb knobs allow increased use of the muscles attached to the thumb, the angle of the sides of the curves emphasize the use of the fingers with stronger muscles attached and the vertical surfaces below the curves steady the palms of the hands. This enables the user to get a stronger grip on the device than would be possible with a round bar allowing the user to perform the pronated pull up exercise easier. The user therefor is able to more easily experience therapeutic stretching of the back which occurs during the course of the pronated pull up exercise.

1 Claim, 2 Drawing Sheets

PULL UP DEVICE WITH THUMB GRASPING KNOBS

BACKGROUND OF THE INVENTION

1. The Field Of the Invention

The present invention relates to a fixed exercise device and more particularly to a fixed device from which an individual may go through the range of motion of the pronated pull up exercise.

2. Description of the Prior Art

The pronated pull up exercise has previously generally been done while suspending one's self from a round bar.

The object of the present invention is to allow the user to be able to grip the present invention in a more effective manner than is possible with a round bar, thus making the pronated pull up exercise easier to do so that therapeutic stretching of the back, which occurs during the exercise, can more easily be accomplished.

A more effective grip is made possible by the present invention, which is unique and different, in the following ways.

1. The body of the invention is of a rectangular shape which presents a flat surface which gives vertical support to the palms of the hands when it is gripped. A round bar provides no such support.
2. There are curved openings in the body of the device: which when gripped, positions the hands at an angle which places greater weight on the stronger fingers of the hands allowing the user to better utilize his or her muscle capacity to a greater extent. A round bar has no curved openings to achieve such an effect.
3. There are two knobs that project out from the top center sides of the curved openings of the invention. These knobs enable the user to grip the invention better with his or her thumbs. This allows utilization of the thumb muscles during the pronated pull up exercise making it easier to do than with a round bar which offers virtually no effective gripping surface for the thumbs during this exercise.

SUMMARY OF THE INVENTION

In the operation of the invention described herein the invention is attached by clamps or other means to uprights that are high enough so that the user will be suspended from the ground when gripping the invention. The user then stands on a raised platform, such as a stool, and grips the invention by wrapping his or her fingers over the center sides of the curved openings and curling his or her thumbs over the knobs situated towards the top of the invention on the center sides of the curved openings. The user then steps off the raised platform, suspending his or her self off the ground by gripping the invention, then proceeds to go through the range of motion of the pronated pull up exercise which strengthens the muscles of the arms and trunk and provides therapeutic stretching of the back.

When the user is suspended above the ground while gripping the present invention, the angles of the curved openings cause a higher proportion of the user's weight to be placed on the user's fingers nearest the thumb. This emphasizes utilization of the stronger muscles connected to those fingers, whereas when suspended from the ground by gripping a round bar the user's weight is distributed more equally among all the user's fingers which does not emphasise utilization of the user's fingers with the stronger muscles thus making the bar harder to grip than the invention described herein. Which makes the exercise harder to do using a round bar.

The flat portion of the present invention below the curved openings provides a surface which steadies the palms of the hands of a a user gripping the invention during the course of the pronated pull up exercise. This allows the user to focus the muscular effort which would be required to steady his or herself, on other aspects of the exercise thereby making it easier to do. A round bar has no such vertical surface to support the palm during the course of the pronated pull up exercise.

The knobs which project out from the top of the invention allow the user to grip the present invention with his or her thumbs in an effective manner not possible with a round bar. This allows the user's thumb muscles to be better used while gripping the invention in the course of performing the pronated pull up exercise. This in turn allows the user to better use his or her muscular abilities while performing the exercise thus allowing therapeutic stretching of the back, which occurs during the exercise, to be done more easily.

DESCRIPTION OF THE PREFERRED EMBODIMENTS

Figure 1:
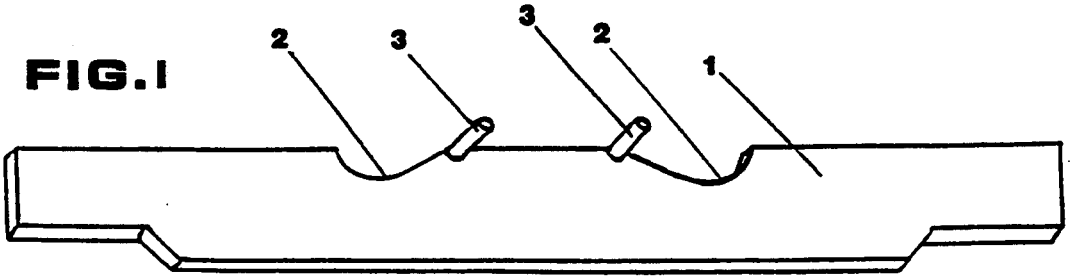
FIG. 1 is a perspective view of the invention described herein this application.
Figure 2:
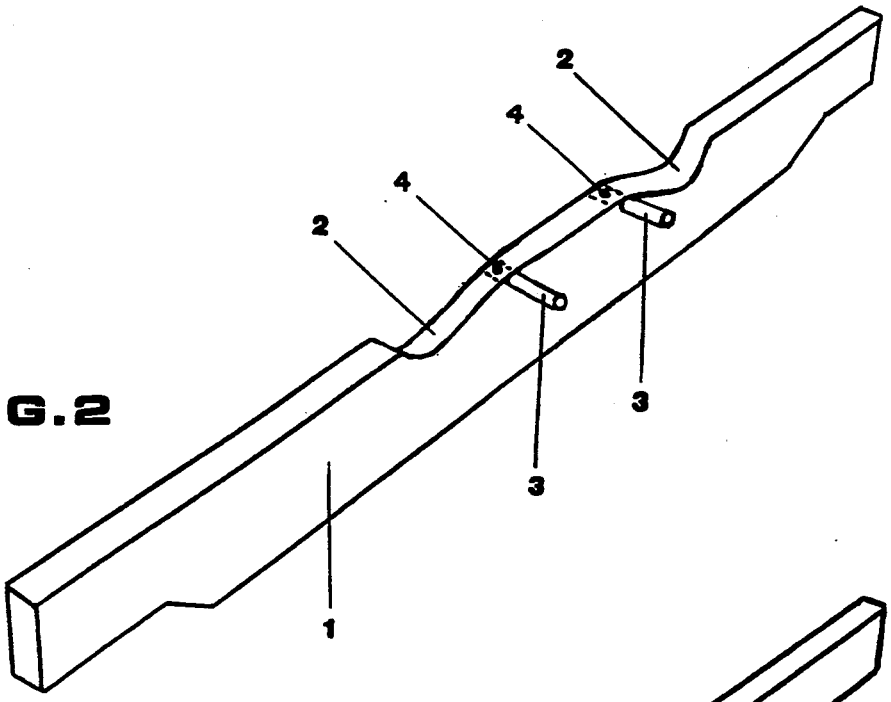
FIG. 2 is a perspective view of the invention from another angle.

Referring to FIG. 1 and 2 of the drawings.

The vertical shape of the body 1 of the deuce is in the shape of a rectangle.

The body 1 of the device may be made in different thicknesses to accommodate different size hands.

The body 1 may be made in different lengths to allow placement on uprights different distances apart.

The height of the body should be sufficient to provide surface for the entire palm of the user's hand.

Wood or other materials such as aluminum or plastic compositions may be used to construct the body 1 and knobs 3 of the device.

There are two curved openings 2 cut out of the top of the body 1.

The function of the curved openings R is to position a users hand at an angle when gripping the device.

The curved openings 2 may be made with different angles to properly accommodate comfortable gripping by different size hands.

Two knobs 3, for gripping with the thumbs by a user, project out two inches from the body 1 at the top center sides of the curved openings 2.

The knobs 3 may be made in different size diameters to accommodate different size hands.

The knobs 3, in the case of wood construction, may be attached to the body 1 by gluing and inserting into holes drilled into the body 1 and then driving a screw 4 down through the portion of the knob 3 embedded in the body 1, the pathway for the screw first being pre-drilled and countersunk at the top.

Figure 3:
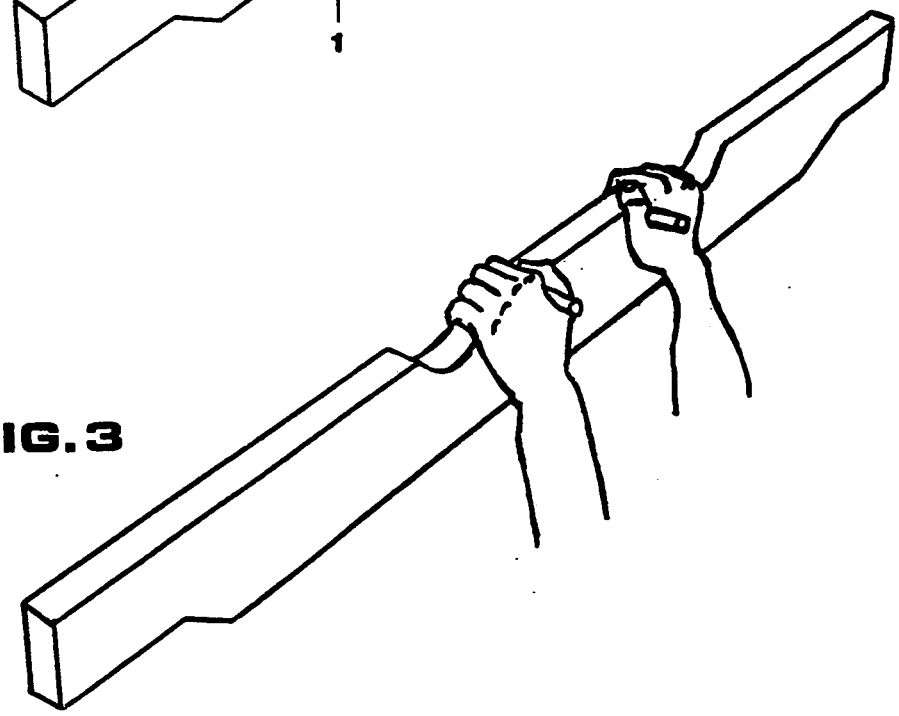
FIG. 3 is a perspective view of the invention, as shown in FIG. 2, being gripped by a user in the manner described herein this application.
Figure 4:
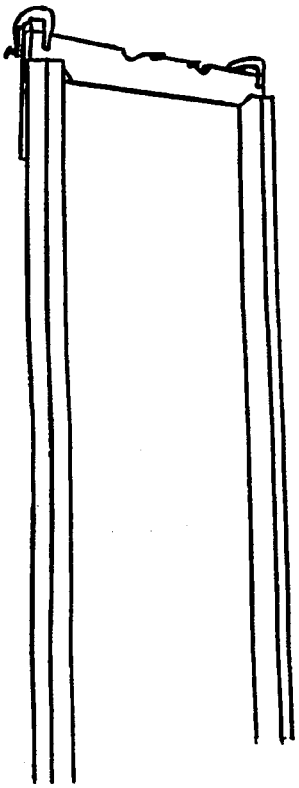
FIG. 4 is a perspective view of the invention clamped to a pair of uprights as described herein.
Figure 5:
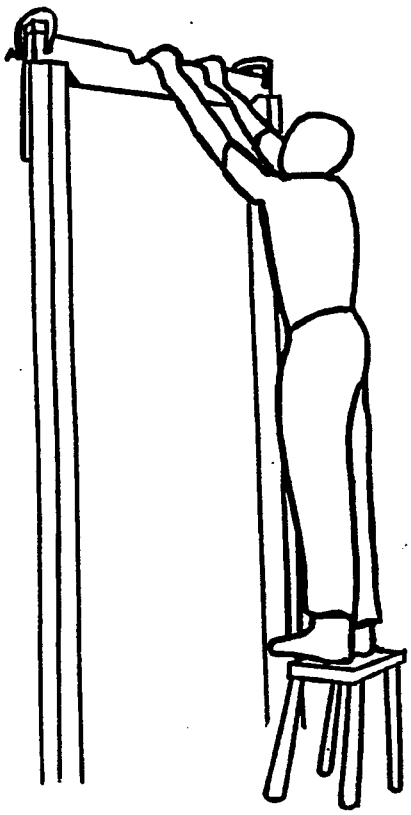
FIG. 5 is a perspective view of a user initially gripping the invention as shown in FIG. 3 and described herein.
Figure 6:
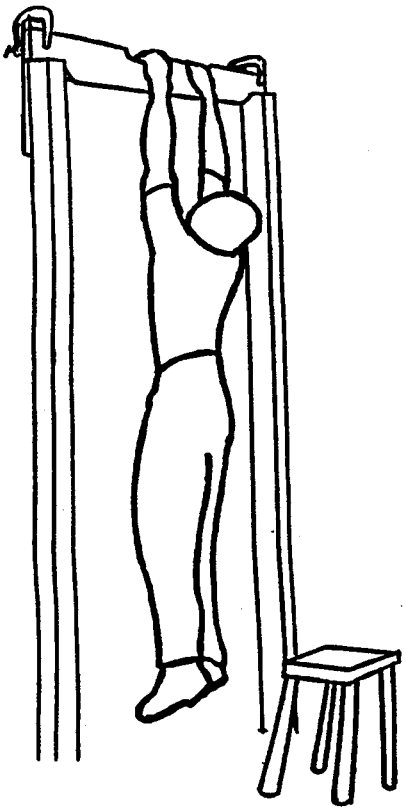
FIG. 6 is a perspective view of a user suspended while gripping the invention as shown in FIG. 3 and described herein.
Figure 7:
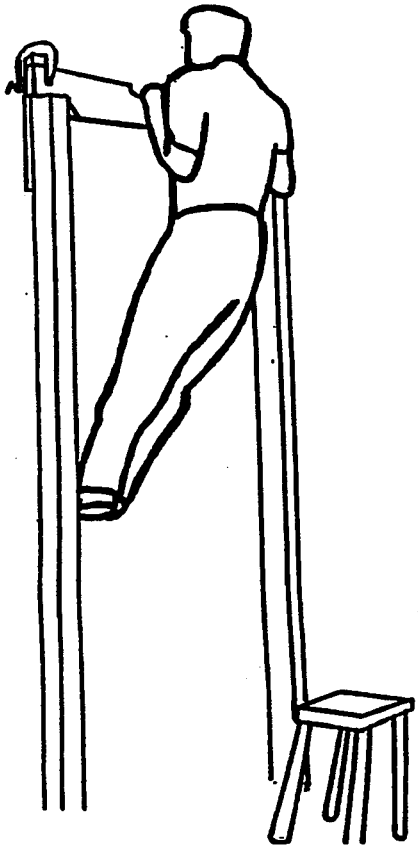
FIG. 7 is a perspective view of a user in the top position of the pronated pull up exercise while gripping the invention as shown in FIG. 3 and described herein.

In use the device is first mounted on uprights, see FIG. 4, the user, standing on a raised platform FIG. 5, then grasps the device as shown in FIG. 3. and steps off the platform suspending himself as shown in FIG. 6 by gripping the device in the manner shown in FIG. 3, the user then performs the pronated pull up exercise which at one point will place him in the position shown in FIG. 7.

I claim:

1. A pull up device for performing pull up exercises comprising:

an elongated rectangular body;

a pair of curved openings located at the top surface of said body near its center;

a pair of knobs which extend out from the upper front surface of said body, said knobs located between said curved openings;

whereby a user grasps said body at said curved locations with the user's thumbs engaging said knobs while performing pull up exercises.

* * * * *